US005193424A

United States Patent [19]

Minichshofer et al.

[11] Patent Number: 5,193,424

[45] Date of Patent: Mar. 16, 1993

[54] APPARATUS FOR APPLYING A NONWOVEN WEB TO A CARRIER WEB MOVING IN THE SAME DIRECTION

[75] Inventors: Klaus Minichshofer, Linz; Hannes Pum, Alberndorf, both of Austria

[73] Assignee: Textilmaschinenfabrik Dr. Ernst Fehrer Aktiengesellschaft, Leonding, Austria

[21] Appl. No.: 717,419

[22] Filed: Jun. 18, 1991

[30] Foreign Application Priority Data

Jun. 22, 1990 [AT] Austria ..... 1331/90

[51] Int. Cl.[5] ..... B26D 5/00; B65H 23/192

[52] U.S. Cl. ..... 83/75; 83/425.003; 83/435.002; 83/649; 83/937; 242/56.002; 242/75.052

[58] Field of Search ..... 83/75, 425.3, 425.4, 83/435.2, 500, 649, 937; 26/51, 87; 226/108; 242/56.2, 62, 75.51, 75.52

[56] References Cited

U.S. PATENT DOCUMENTS

| | | | |
|---|---|---|---|
| 2,309,045 | 1/1943 | Clayton, Jr. | 242/56.2 |
| 2,379,132 | 6/1945 | Cook | 242/75.52 X |
| 2,707,027 | 4/1955 | Brown | 83/75 |
| 3,072,309 | 1/1963 | Hill | 242/56.2 X |
| 3,156,426 | 11/1964 | Brock | 242/56.2 |
| 3,755,861 | 9/1973 | Castro et al. | 242/75.52 X |
| 3,782,649 | 1/1974 | Frederick et al. | 242/75.52 X |
| 3,785,232 | 1/1974 | Frye et al. | 83/500 X |
| 4,384,665 | 5/1983 | Waddington | 242/75.51 X |
| 4,700,598 | 10/1987 | Gerber | 83/649 X |

*Primary Examiner*—Frank T. Yost
*Assistant Examiner*—Raymond D. Woods
*Attorney, Agent, or Firm*—Collard & Roe

[57] ABSTRACT

In an apparatus for applying a nonwoven web to a carrier web moving in the same direction, it is to be ensured that the nonwoven web has straight longitudinal edges as it is applied to the carrier web. This is accomplished in permitting the unwound nonwoven web to sag freely in a slack loop between the unwinding station and a feeding conveyor which precedes the edge-trimming device. The velocities of conveyance of the feeding conveyor and of the take-off rolls have a predetermined ratio in dependence on the velocity of the receiving surface on which the carrier web receives the nonwoven web and are controlled in such a manner that the nonwoven web will be subjected to a predetermined tensile stress between the take-off rolls and the carrier web.

3 Claims, 1 Drawing Sheet

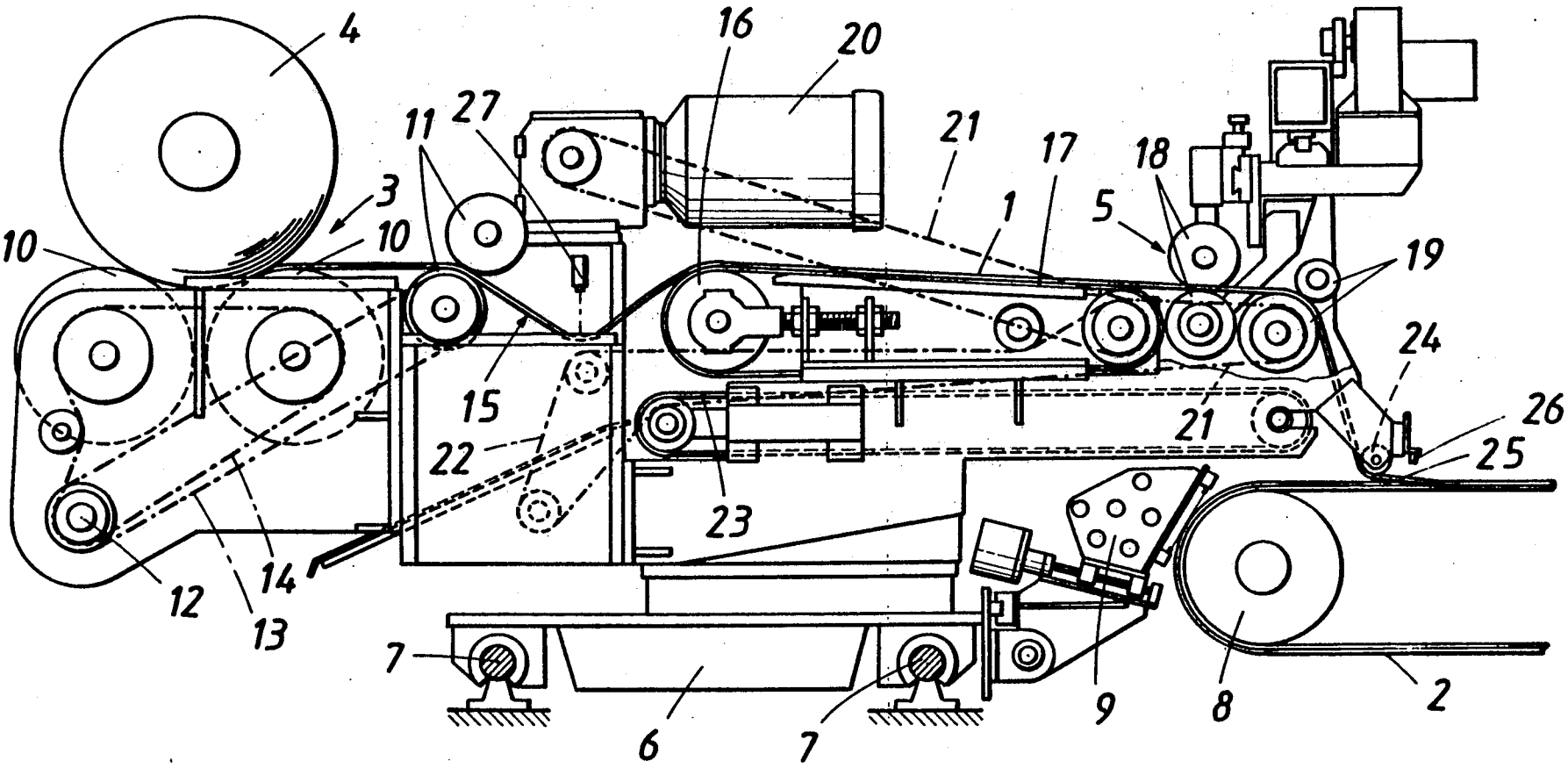
26
25
24
19
2
8
21
18
5
9
17
1
21
20
7
16
23
6
27
15
22
11
7
3
10
4
14
13
12
10

APPARATUS FOR APPLYING A NONWOVEN WEB TO A CARRIER WEB MOVING IN THE SAME DIRECTION

BACKGROUND OF THE INVENTION

1. Field of the Invention

This invention relates to an apparatus for applying a nonwoven web to a carrier web moving in the same direction, comprising unwinding means for a roll of a nonwoven web, edge-trimming means for the nonwoven web which has been unwound, and take-off rolls, which succceed the edge-trimming means and serve to tension the nonwoven web adjacent to the edge-trimming means.

2. Desccription of the Prior Art

To permit an application of a nonwoven web in a plurality of juxtaposed convolutions to a usually endless revolving carrier web in such a manner that adjacent convolutions are closely juxtaposed or overlap each other in a predetermined width, care must be taken to ensure that the longitudinal edges of the nonwoven web recceived by the carrier web are at least substantially straight. To that end the nonwoven web unwound from a roll thereof is trimmed at its longitudinal edges before it is applied to the carrier web. Blut it has been found in practice that such edge trimming of the nonwoven web moving toward the carrier web is not sufficcient in itself to ensure that the longitudinal edges of the nonwoven web which has been deposited on the casrrier web are sufficiently straight to meet stringent requirements even though the nonwoven web is continuously tensioned between the unwinding means and the take-off rolls to ensure that the longitudinal edges of the nonwoven web will be trimmed along straight lines by means of leterally disposed cutting disks of the edge-trimming means. Even after the longitudinal edges of the nonwoven web have been trimmed the external loads on the nonwoven web and its inherent stresses may result in an unpredictable distortion of the nonwoven web because it has a low inherent strength.

SUMMARY OF THE INVENTION

For this reason it is an object of the invention to avoid said disadvantages and so to improve such an apparatus by single means that the longitudinal edges of the nonwoven web will be straight as the woven web is applied to the carrier web moving in the same direction.

The object set forth is accomplished in accordance with the invention by permitting the unwound nonwoven web to sag freely in a slacck loop between the unwinding means and a feeding conveyor, which precedes the edge-trimming means, and the velocities of cconveyance of the feeding conveyor and of the take-off rolls have a predetermined ratio and in dependence on the velocity of the receiving surface on which the carrier web receives th enonwoven web are adapted to be controlled in such a manner that the nonwoven web will be subjected to a predetermined tensile stress between the take-off rolls and the carrier web.

The invention is based on the recognition that by the application of a predetermined external load to the edge-trimmed nonwoven web being delivered to the carrier web said nonwoven web can be subjected to a tensile stress which will determine the course of its longitudinal edges and which will compensate the inherent stresses and will provide for a uniform load on the nonwoven web so that its longitudinal edges will be straight. That external load will be applied by the control of the velocity of conveyance of the take-off rolls in dependence on the velocity of the receiving surface on which the nonwoven web is entrained by the carrier and will be determined by the ratio of said velocities. Because the surface velocity of the ccarrier web usually trained around reversing pulleys will depend on the thickness of the carrier web and the thickness by which the surface velocity is determined will have been changed when a preceding nonwoven web layer has been needled to the carrier web, it is necessary to take such thickness changes into account in a detection of the velocity of the revolving carrier web for use in the control of the velocity of conveyance of the take-off rolls so that constant tension conditions in the nonwoven web between the take-off rolls and the carrier web will be ensured. But such a control of the tensile stress will not produce the desired result unless the inherent stresses existing in the nonwoven web can be limited. For this reason the greatly varying stresses existing in the roll of the nonwoven web and occurring in the nonwoven seb as it is unwound must substantially be compensated by the provision of at least one slack loop permitting the nonwoven web to sag freely between the unwinding device and the edge-trimming device. Because stresses which are due to the weight of the web moving along said loop may be disturbing in special cases, such stresses may be avoided by the provision of a plurality of smaller sag-permitting loops. But the slack loop must not adversely affect the tension which is required in the nonwoven web to permit its edge trimming. For this reason a feeding conveyor must be associated with the edge-trimming means and it is necessary to subject the nonwoven web between the feeding conveyor and the succeeding take-off rolls to a tensile stress which is determined by the ratio of the velocities of conveyance of the feeding conveyor and the take-off rolls. When the velocity of conveyance of the take-off rolls is changed in response to a change of the surface velocity of the carrier web, it will obviously be necessary to change also the velocity of conveyance of the feeding conveyor so that the predetermined ratio will be maintained.

To ensure that the weight of the nonwoven web moving along the slack loop cannot give rise to new irregularities in the stress distribution in case of a changing sag, it will be recommendable so to control the unwinding velocity of the unwinding means that the sag of the nonwoven web moving along the slack loop will automatically be controlled and will thus be maintained in a predetermined range. Upon a change of the surface velocity of the carrier web, the velocity at which the nonwoven web is unwound from the roll thereof must also be influenced by the automatic control of the sag.

The receiving surface on which the carrier web receives the nonwoven web will be constituted by the top surface of the carrier web proper or by the top surface of a layer formed by a portion of the nonwoven web which has previously been applied to the carrier web.

The maintenance of a predetermined ratio between the velocities of conveyance of the feeding conveyor and the take-off rolls can be ensured in a simple manner by the provision of a common drive for the feeding conveyor and the take-off rolls so that the feeding conveyor and the take-off rolls can be controlled by a control of the common drive, from which the driving movements are derived by suitable transmissions, which may be adjustable in case of need.

BRIEF DESCRIPTION OF THE DRAWING

The drawing is a schematic side elevation showing an apparatus which embodies the invention and serves to apply a nonwoven web to a carrier web moving in the same direction.

DETAILED DESCRIPTION OF THE PREFERRED EMBODIMENT

The invention is illustrated by way of example on the drawing, which shows an illustrative embodiment of an apparatus for applying a nonwoven web 1 to a carrier web 2 moving in the same direction. That apparatus substantially consists of means 3 for unwinding a nonwoven web from a roll 4 thereof and of means 5 for edge trimming the nonwoven web 1 which has been unwound. The edge-trimming means 5 and the unwinding means 3 are both mounted on a carriage 6, which is movable transversely to the longitudinal direction of the carrier web 2. That carriage 6 is movably mounted on track rails 7 and is adapted to be moved by a drive, not shown, in dependence on the lead of the convolutions formed by the nonwoven web applied to the endless carrier web 2, which is trained around reversing pulleys 8. In this manner adjacent convolutions of the nonwoven web may be caused exactly to adjoin each other at juxtaposed edges. For the control of the traversing movement of the carriage, the free longitudinal edge of the last convolution of the nonwoven web which has been applied to the carrier web 2 and which is to be adjoined by a new convolution of the nonwoven web to be applied is detected by a photoelectric scanning sensor 9, which is reciprocated over the longitudinal edge of the last convolution of the nonwoven web that has been applied and in a direction which is transverse to said free longitudinal edge.

The means 3 for unwinding the roll 4 of the nonwoven web comprise two rollers 10 for supporting the roll 4 of the nonwoven web and a pair of take-off rolls 11. Said take-off rolls 11, on the one hand, and the rollers 10, on the other hand, are driven by a common drive shaft 12 by means of respective chain drives 13 and 14. The unwound nonwoven web 1 delivered by the pair of take-off rolls 11 is permitted to sag freely in a slack loop 15 in the nonwoven web and is subsequently received by a feeding conveyor 16, which comprises a revolving conveyor belt 17 and directly precedes the edge-trimming means 5. Because the edge trimming means 5 provided with laterally disposed cutting disks 18 is disposed between the feeding conveyor 17 and the take-off rolls 19, it is possible to subject the nonwoven web 1 adjacent to the edge-trimming means 5 to a suitable tensile stress, which is an essential requirement for a straight cut. For that purpose the take-off rolls 19 must be driven to operate at a correspondingly higher velocity of conveyance than the feeding conveyor 16. This is ensured in that the driving movements are derived at predetermined transmission ratios from a common drive 20. As is apparent from the drawing, the feeding conveyor 16 is driven by a chain drive 21, from which the drive of the take-off rolls 19 is derived via a chain 22, which drives not only the take-off rolls 19 but drives also a conveyor belt 23 for removing the longitudinal edge strips which have been removed from the nonwoven web as it was trimmed at its edges.

The edge-trimmed nonwoven web delivered by the take-off rolls 19 is then deflected by a deflecting guide 24 and is subsequently applied to the carrier web 2 while the nonwoven web is maintained under a predetermined tensile stress so that a straight course of the longitudinal edges of the portion 25 of the nonwoven web between the take-off rolls 19 and the carrier web 2 will be ensured. That tensile stress in the portion 25 of the nonwoven web will be ensured in that the velocity of conveyance of the take-off rolls 19 is controlled in dependence on the velocity of the receiving surface on which the portion 25 of the nonwoven web is received by the carrier web. To that end a predetermined ratio depending on the thickness of the carrier web 2 is maintained between the velocity of the revolving carrier web 2 and the velocity of conveyance of the take-off rolls 19 and the drive 20 is controlled to maintain that ratio. Whereas the tensile stress of the portion 25 of the nonwoven web cannot directly be measured, that tensile stress can be ascertained by a detection of the change of the clearance between the portion 25 of the nonwoven web and the carrier web 2 as said portion travels between the deflection guide 24 and the carrier web 2 and the change of said clearance can be utilized for the control. The change of that clearance can be detected by a non-contacting photoelectric clearance sensor 26 operated as an actual-value signal generator.

The sag of the nonwoven web in the slack loop 15 is maintained within predetermined limits so that a constant influence of the weight of the nonwoven web on the stresses in the non-woven web as it moves along the slack loop 15 will be ensured. To that end a photoelectric clearance sensor 27 for detecting the sag is provided and the actual value of the sag detected by sensor 27 is compared in a controller with a predetermined set point. Upon a detection of a difference between the set point and the actual value the unwinding velocity of the unwinding means 3 is changed to adjust the actual value to the set point. When the velocity of conveyance of the feeding conveyor 16 is changed in dependence on the surface velocity of the carrier web 2, that velocity change will cause the sensor 27 to effect a corresponding change of the speed of the shaft 12 for driving the unwinding means 3 because the sag will be detected by the sensor 27.

The inherent stresses in the nonwoven web which has been unwound from the roll 4 are compensated as the nonwoven web moves along the slack loop 15 and the nonwoven web will be subjected to a predetermined tensile stress before it is deposited on the carrier web. That tensile stress can be controlled at least in sections of the length of the nonwoven web and will be superimposed on otherwise occurring inherent stresses. As a result such irregular inherent stresses cannot disturb the course of the longitudinal edges of the edge-trimmed nonwoven web so that the proposed measures will actually ensure that adjacent convolutions of the nonwoven web will be deposited with closely juxtaposed longitudinal edges or exactly with a predetermined overlap. The matching of the various velocities of conveyance may be ensured in various ways by known control techniques, which for that reason need not be discussed more in detail herein.

We claim:

1. In an apparatus for applying a nonwoven web to a receiving surface of a carrier web moving in a predetermined direction for conveying the nonwoven web on said receiving surface, comprising unwinding means for unwinding said nonwoven web from a roll thereof, edge-trimming means for trimming said nonwoven web at its longitudinal edges, and take-off rolls for pulling said nonwoven web from said edge-trimming means so as to tension said nonwoven web adjacent to said edge-trimming means and for delivering said nonwoven web to said receiving surface, the improvement comprising a feeding conveyor for receiving said nonwoven web from said unwinding means and for delivering said nonwoven web to said edge-trimming means, said unwinding means and said feeding conveyor supporting therebetween respective ends of a slack loop permitting said nonwoven web to sag freely in said loop, drive means for operating said feeding conveyor and said take-off rolls at respective velocities of conveyance having a predetermined ratio to each other, and tension control means for controlling said drive means to operate in dependence on the velocity of said receiving surface, said feeding conveyor and said take-off rolls at such velocities of conveyance that said nonwoven web will be subjected to a tensile stress between said take-off rolls and said receiving surface.

2. The improvement set forth in claim 1, comprising control means for automatically controlling the velocity of conveyance of said unwinding means to maintain the sag of said nonwoven web in said slack loop within predetermined limits.

3. The improvement set forth in claim 1, wherein said drive means comprises a common drive for operating said feeding conveyor and said take-off rolls.

* * * * *